US009282412B2

(12) United States Patent
Duisters

(10) Patent No.: US 9,282,412 B2
(45) Date of Patent: Mar. 8, 2016

(54) SEAL-QUALITY ESTIMATION FOR A SEAL FOR AN EAR CANAL

(75) Inventor: Ronald Petrus Nicolaas Duisters, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 210 days.

(21) Appl. No.: 13/995,658

(22) PCT Filed: Jan. 2, 2012

(86) PCT No.: PCT/IB2012/050005

§ 371 (c)(1), (2), (4) Date: Oct. 22, 2013

(87) PCT Pub. No.: WO2012/093343

PCT Pub. Date: Jul. 12, 2012

(65) Prior Publication Data

US 2014/0037096 A1 Feb. 6, 2014

(30) Foreign Application Priority Data

Jan. 5, 2011 (EP) ..... 11150160

(51) Int. Cl.
*H04R 29/00* (2006.01)
*H04R 25/00* (2006.01)

(52) U.S. Cl.
CPC ..... *H04R 29/00* (2013.01); *H04R 25/30* (2013.01); *H04R 2430/03* (2013.01); *H04R 2460/15* (2013.01)

(58) Field of Classification Search
None
See application file for complete search history.

(56) References Cited

U.S. PATENT DOCUMENTS

| | | | | |
|---|---|---|---|---|
| 3,985,960 | A | 10/1976 | Wallace, Jr. | |
| 7,477,754 | B2 | 1/2009 | Rasmussen et al. | |
| 8,804,972 | B2 * | 8/2014 | Klein et al. | 381/56 |
| 2002/0076057 | A1 * | 6/2002 | Voix | 381/60 |

(Continued)

FOREIGN PATENT DOCUMENTS

| | | | |
|---|---|---|---|
| EP | 1465454 | A2 | 6/2004 |
| EP | 1592283 | A2 | 11/2005 |

(Continued)

OTHER PUBLICATIONS

Susan E. Mercy et al, "Experimentation to Address Appropriate Test Techniques for Measuring the Attenuation Provided by Double ANR Hearing Protectors", In New Directions for Improving Audio Effectiveness (pp. 18-1-18-14). Meeting Proceedings, RTO RTO-MP-HFM-123, Paper 18. Neuilly-sur-Seine, France: RTO. Available from http://www.rto.nato.int/abstracts.aps.

(Continued)

*Primary Examiner* — Andrew L Sniezek

(57) ABSTRACT

Measurements of body sounds in the ear canal may be used for many applications. However, reliability is dependent on the ear canal being properly sealed to allow the body sounds to achieve a detectable level. An apparatus is therefore provided for determining a seal quality indication for a seal of an ear canal. An ear canal microphone (201) provides a microphone signal to an input (203) which is coupled to a circuit (205) for generating a first signal from the microphone signal. The first signal may be the same as the microphone signal. A circuit (209) then determines the seal quality in response to the frequency spectrum for the first signal. A frequency transformer (207) may perform a frequency transformation on the first signal to generate a frequency spectrum for the first signal and. The seal quality indication may specifically be generated based on a detection of a low frequency boost.

14 Claims, 4 Drawing Sheets

(56) References Cited

U.S. PATENT DOCUMENTS

| | | | | |
|---|---|---|---|---|
| 2003/0220584 | A1 | 11/2003 | Honeyager et al. | |
| 2004/0136540 | A1 | 7/2004 | Iwasaki et al. | |
| 2009/0080670 | A1 | 3/2009 | Solbeck et al. | |
| 2009/0122996 | A1 | 5/2009 | Klein et al. | |
| 2015/0092948 | A1* | 4/2015 | Usher et al. | 381/58 |

FOREIGN PATENT DOCUMENTS

| | | | |
|---|---|---|---|
| WO | 2008103925 | A1 | 8/2008 |
| WO | 2009069037 | A2 | 6/2009 |

OTHER PUBLICATIONS

Stenfelt et al: "A Model of the Occlusion Effect With Bone-Conducted Stimulation"; Internaitonal Journal of Audiology 2007, vol. 46, pp. 595-608.

Duisters et al: "In-Ear Monitoring of Vital Sounds"; Technical Note TN-2009/00685, Philips Research Europe, Issued Aug. 2010, 39 Page Document.

Kechichian et al: "Monitoring of Vital Body Signals Using Acoustic Analysis"; Technical Notet PR-TN 2009/00475, Philips Research Europe, Issued Sep. 2009, 33 Page Document.

* cited by examiner

SEAL-QUALITY ESTIMATION FOR A SEAL FOR AN EAR CANAL

FIELD OF THE INVENTION

The invention relates to a method and apparatus for determining a seal quality indication for a seal of an ear canal and in particular, but not exclusively, to determination of a seal quality indication for body sound measuring applications.

BACKGROUND OF THE INVENTION

There is an increasing interest in monitoring body functions for various applications. For example, there is an interest in monitoring heart rate and breathing characteristics for relaxation, exercise and medical applications.

It has been proposed to measure body sounds by placing a microphone in the ear canal. Indeed body sounds, are transmitted through the body via bone conduction, among others. Interesting sounds that can be captured inside the ear canal include heart sounds, breathing sounds and motion sounds such as footsteps. It has been found that it is possible to record such body sounds inside the ear canal by making use of what is known as the occlusion effect. The occlusion effect refers to the phenomenon that inside an occluded ear canal, bone conducted sounds are perceived stronger than in an open ear canal. Besides this perceptual aspect, this effect can also be measured in terms of an increased sound pressure for low frequencies inside the ear canal. The explanation for this phenomenon is given in the article "Bone Conduction" by J. Tonndorf; in J. Tobias (ed.), Foundations of modern auditory theory, New York: Academic press, p. 197-237. For sounds inside the ear canal, the open end of the canal results in a high pass characteristic. As soon as the ear canal is sealed, the high pass characteristic is lost and the sound pressure level of low frequency sounds in the ear canal increases. More details of the occlusion effect with respect to different types of seals are provided in the article "A model of the occlusion effect with bone-conducted stimulation" by S. Stenfelt and S. Reinfeldt; International Journal of Audiology, vol. 46, p. 595-608, 2007. In this article, the occlusion effect is measured from 100 Hz upward, and it is found to extend up to 2 kHz, for some cases.

Research has been undertaken in positioning a microphone in the ear canal and sealing the ear to provide the occlusion effect. FIG. 1 illustrates an example of an ear microphone system where the microphones and seal are integrated in an earpiece such that the positioning of the earpiece in the ear both positions the microphone in the ear canal and seals the ear canal.

However, in order to be able to sufficiently clearly record bone-conducted body sounds in the ear canal using a microphone, the canal needs to be sealed properly. This seal will result in the occlusion effect which introduces a significant increase of the measured sound pressure level of the bone-conducted body sounds with respect to an open ear canal. As microphones suffer from self noise and therefore have a limited dynamic range, a significant sound pressure level at the microphone position is required to capture the desired body sounds. Thus, when using an ear microphone for recording body sounds, such as heart sounds and breathing sounds, the occlusion of the ear canal needs to be sufficiently good enough to provide a high enough sound-pressure level for body sounds in the ear canal. This requires an effective seal of the ear canal with respect to the external world to be present. If the sealing is not sufficient, the body sounds reduce dramatically in level and it becomes difficult or even impossible to derive specific information from the body sounds. Furthermore, the seal not only provides an increase in the level of the body sounds but also an attenuation of external sounds thereby improving signal to noise ratios.

Therefore the quality of the seal of the ear canal is very important for applications measuring body sounds in the ear canal. However, for examples such as e.g. that of FIG. 1, this requires that the earpieces are positioned correctly in the ear to provide a tight seal. As it may be performed by an inexperienced user, the positioning may often be suboptimal.

Accordingly an approach for estimating the quality of the seal of an ear canal would be advantageous. In particular an approach allowing increased flexibility, facilitated implementation, improved accuracy, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a method of detecting a seal quality indication for a seal of an ear canal, the method comprising: receiving a microphone signal from an ear canal microphone positioned in the ear canal; generating a first signal from the microphone signal; and determining the seal quality indication in response to a characteristic of a frequency spectrum of the first signal.

The invention may provide an advantageous seal detection. The approach may for example allow body sound capturing applications to provide improved performance by ensuring that the seal is sufficient for sufficiently reliable capture. The approach may be of low computational complexity and may require only a low computational resource. For example, in a digital implementation a very low sample rate can be used to determine the seal quality. Indeed, in some embodiments a sample rate as low as 100 Hz may be used. Reliable estimates of the quality of the seal can be generated, and the seal quality indication may e.g. allow the reliability of body sound measurements to be estimated.

The determination of seal quality based on frequency domain characteristics may allow a more accurate and reliable determination of seal quality in many scenarios.

The first signal may correspond directly to the microphone signal, and may in some embodiments be the microphone signal itself. In some scenarios the first signal may be a weighted combination of the microphone signal and a second signal, such as e.g. a difference signal between these. The first signal may in some embodiments correspond to a scaled and/or filtered version of the microphone signal. In some embodiments, the first signal may correspond to the microphone signal relative to a second signal, such as an ambient signal representing ambient noise.

In some embodiments the seal quality indication may be a binary seal quality indication. Specifically, the method may simply determine whether the seal quality is deemed sufficiently good or not.

In some embodiments, the approach may be applied to both ears of a user.

In accordance with an optional feature of the invention, the seal quality indication is determined in response to a variation of a magnitude of the frequency spectrum with frequency.

This may provide improved performance and may in many scenarios allow a reliable seal quality determination. The seal quality indication may be determined in response to a characteristic representing how the magnitude of the frequency spectrum (such as amplitude or power) varies as a function of frequency. For example, the signal quality indication may be determined in response to a comparison of (e.g. accumulated) magnitudes of different frequency intervals.

In accordance with an optional feature of the invention, the seal quality indication is determined in response to a gradient of the magnitude as a function of frequency in a frequency interval.

This may provide a particularly advantageous determination of a seal quality indication in many scenarios. The gradient may specifically be a slope of the increasing signal level for reducing frequencies for a low frequency band. For example, the gradient may be determined for frequencies below 100 Hz or even below 50 Hz. The frequency spectrum and/or the determined gradient may be an averaged frequency spectrum or gradient to provide a more reliable estimate.

In some embodiments, the frequency interval may advantageously have an upper cut-off frequency of no more than 200 Hz, 100 Hz, 70 Hz or even 50 Hz. The cut-off frequency may e.g. be a 3 dB or 6 dB cut-off frequency.

In accordance with an optional feature of the invention, determining the seal quality indication comprises determining the seal quality indication to indicate an increasing value of quality for an increasing amplitude of the gradient.

The method may specifically determine an increasing seal quality for an increasing magnitude of the gradient to reflect that an effective seal tends to provide an increased amplification of low frequencies resulting in an increasing gradient.

In accordance with an optional feature of the invention, the seal quality indication is determined in response to a comparison of a combined signal level in a first frequency band having an upper frequency, and a combined signal level in a frequency interval including a second frequency band of frequencies above the upper frequency.

This may provide a reliable seal quality indication in many applications while maintaining a low complexity approach. A low computationally resource usage can typically be achieved.

The frequency interval may include part or the whole of the first frequency band but also includes the second frequency band which is not included in the first frequency band.

The approach may thus allow a seal quality indication determination based on a comparison of signal levels in a low(er) frequency band relative to signal levels in a high(er) frequency band. This may provide an efficient indication of the achieved occlusion effect of the seal.

The frequency interval may in some embodiments correspond to the entire audio frequency band (or even more). In other embodiments, the frequency interval may e.g. only include frequencies not included in the first frequency band.

In some embodiments, the first frequency band may have substantially the same bandwidth as the frequency interval.

In accordance with an optional feature of the invention, the upper frequency is not above 100 Hz.

This may provide a particularly advantageous indication of the occlusion effect and thus of the seal quality. In some embodiments, the upper frequency is not above 70 Hz, or even 50 Hz.

In accordance with an optional feature of the invention, the second frequency band has an upper frequency of no less than 500 Hz.

This may provide a particularly advantageous reference for estimating the achieved occlusion effect and thus of the seal quality. In some embodiments, the upper frequency is no less than 700 Hz, or even 1 kHz.

In accordance with an optional feature of the invention, the seal quality indication is determined as a function of no other signal dependent parameters than a signal level in a frequency band having an upper cut-off frequency of no more than a 100 Hz.

This may allow a very low complexity determination of a seal quality indication, yet provide an estimate which may be sufficient in many applications.

The signal level may be an accumulated or average signal level or may e.g. be a peak signal level. The upper cut-off frequency may e.g. be a 3 dB or 6 dB cut-off frequency.

In some embodiments, the determination may be of a binary seal quality indication.

Indeed, in some embodiments determining the seal quality indication comprises determining a binary seal quality indication designated to be acceptable when a signal level in a frequency band having an upper cut-off frequency of no more than a 100 Hz exceeds a threshold and designated to not be acceptable otherwise.

This may allow a reliable determination of whether the seal quality is considered adequate or not.

The signal level may be an accumulated or average signal level or may e.g. be a peak signal level. The upper cut-off frequency may e.g. be a 3 dB or 6 dB cut-off frequency.

In accordance with an optional feature of the invention, the method further comprises generating a user alert in response to a detection of the seal quality indication not meeting a criterion.

Thus may provide an efficient yet simple approach for ensuring that the seal quality is acceptable. For example, if the seal quality is designated as acceptable a green light is lit, and if it is designated not acceptable a red light is lit thereby providing easy to understand instant feedback to a user positioning the earpieces in the ears.

In accordance with an optional feature of the invention, the method further comprises determining a user motion characteristic in response to the microphone signal; and determining the seal quality indication in response to the user motion characteristic.

This may provide improved operation and accuracy in many scenarios. In particular, the body sounds in the ear canal depend significantly on whether a person is moving or not, and the approach may allow this to be estimated and accordingly compensated for, or indeed actively exploited.

In accordance with an optional feature of the invention, the method further comprises setting a processing parameter for the microphone signal in response to the motion characteristic.

This may provide improved performance. For example, a gain adaptation may be performed based on the motion characteristic.

In accordance with an optional feature of the invention, the method further comprises receiving an ambient microphone signal from a microphone external to the ear canal; and the seal quality indication is further determined in response to the ambient microphone signal.

This may provide a more accurate seal quality in many scenarios and may mitigate or reduce effects of external noise. In some embodiments, the first signal may be determined in response to a comparison of the microphone signal and the ambient microphone signal. In particular, the first signal may be a difference signal between the two microphone signals.

In accordance with an optional feature of the invention, the method further comprises generating the frequency spectrum by an averaging of frequency spectrums of a plurality of windows.

This may provide a more reliable seal quality indication.

In accordance with an optional feature of the invention, the method further comprises: executing a body sound application based on the microphone signal; and adapting a characteristic of a processing of the body sound application in response to the seal quality indication.

This may allow improved performance of applications based on capturing body sounds and may in particular allow improved reliability. For example, for reducing seal quality an increased low pass filtering of the microphone signal may be applied. As another example reduced weight may be applied to body sound measurements associated with an indication of a low seal quality compared to body sound measurements associated with an indication of a high seal quality.

According to an aspect of the invention there is provided an apparatus apparatus for determining a seal quality indication for a seal of an ear canal, the apparatus comprising: an input for receiving a microphone signal from an ear canal microphone; a circuit for generating a first signal from the microphone signal; and a circuit for determining the seal quality indication in response to a characteristic of a frequency spectrum of the first signal.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to determination of a seal quality for a sealed ear canal microphone and in particular to such seal detection for use in an application for measuring body sounds in the ear canal. However, it will be appreciated that the invention is not limited to this application but may be applied to any application using an in ear canal microphone together with a seal of the ear canal. It will also be appreciated that the approach may be used for any potential sealing of the ear canal and does not require this sealing to be made by the microphone element itself.

The approach will be described with reference to the seal of one ear but it will be appreciated that the approach can be applied in parallel to both ears. Indeed, in some cases a single seal quality indication for both ears can be generated by combining individual seal quality indications for both ears.

Figure 2:
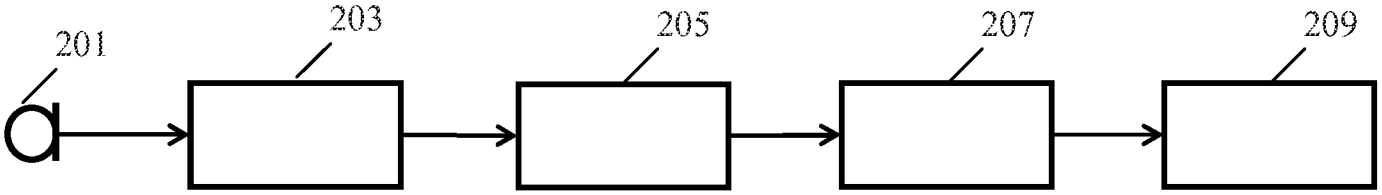
FIG. 2 is an illustration of elements of an example of an apparatus for determining a seal quality indication for a seal for an ear canal in accordance with some embodiments of the invention.
Figure 3:
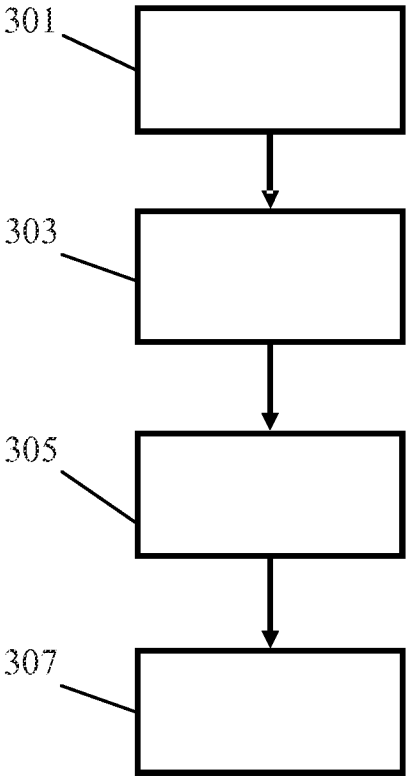
FIG. 3 is an illustration of an example of a method of determining a seal quality indication for a seal of an ear canal in accordance with some embodiments of the invention.

FIG. 2 illustrates an example of an apparatus for determining a seal quality indication for a seal of an ear canal in accordance with some embodiments of the invention. FIG. 3 illustrates an example of a method for determining a seal quality indication for a seal of an ear canal in accordance with some embodiments of the invention. The method of FIG. 3 will be described with reference to the apparatus of FIG. 2.

FIG. 2 illustrates a microphone 201 which is an ear canal microphone. Thus, the microphone is arranged to be positioned in a user's ear canal when in use. In the example, the microphone 201 furthermore provides a seal of the ear canal. For example, the microphone may be located in a housing surrounded by resilient and flexible material that can compress and expand to provide a suitable seal of the ear. Thus, when the user inserts the microphone in the ear, the user also blocks or seals the ear canal. Depending on the exact fit and positioning, the seal may be more or less effective and may in some scenarios only be a partial blocking or sealing of the ear canal.

The apparatus of FIG. 2 is arranged to determine an indication of the quality of the seal provided by the microphone 201.

It will be appreciated that the microphone and seal being integrated into a single element that is simply positioned in the ear allows for a more practical approach and in many scenarios provides increased flexibility and user friendliness. However, the approach may be used for other scenarios such as e.g. where a seal is provided by a separate element, such as an earplug.

The microphone 201 is coupled to an input receiver 203 which performs step 301 wherein the apparatus receives a microphone signal from the microphone 201. The microphone signal may thus comprise signal components arising from body sounds that have been carried to the ear canal by bone conduction and signal components from external sounds.

The microphone signal comprises signal components from body sounds such as heart beats, breathing movements, and user movement (footsteps, walking and running or even arm or head movements). These signal components may be used in many different applications, such as for example exercise applications that can use the signal to determine e.g. heart rate or pace of walking/running Various such algorithms will be known to the skilled person, and it will be appreciated that the approach is applicable to many different such applications.

However, in order to ensure an accurate capturing of body sounds it is required that the ear canal is sufficiently sealed. In order to determine this, the system proceeds to generate a seal quality indication which is indicative of the quality of the sealing of the ear-canal. Specifically, the seal quality may be a binary indication which simply indicates whether the seal is considered to be acceptable or not.

The seal quality indication is based on the signal captured by the microphone 201 and may specifically be determined based only on this signal. Thus, the apparatus of FIG. 2 processes the captured microphone signal and provides an estimate of the degree of sealing of the ear canal which is achieved.

The receiver is coupled to a pre-processing circuit 205 which executes step 303 that provides a first signal generated from the input signal. In some embodiments, the first signal may simply correspond to the microphone signal, e.g. after some filtering, sampling, amplification etc. In other embodiments, more complex processing may be applied, and the first signal may be generated in response to other signals and may specifically be generated as a difference signal.

The following description will focus on an example where the first signal is essentially the same as the microphone signal (typically amplified to a suitable signal level).

The pre-processing circuit 205 is coupled to a frequency transform circuit 207 which is arranged to execute step 305 wherein a frequency transform is applied to the first signal to generate a frequency spectrum. The frequency transform may typically be a Fourier transform such as a Fast Fourier Transform (FFT).

The frequency transform circuit 207 generates a frequency spectrum for the first signal, and accordingly in the example generates a frequency spectrum for the microphone signal.

The frequency transform circuit 207 is further coupled to a seal quality estimator 209 which executes step 307 wherein a seal quality indication is determined in response to the frequency spectrum.

Thus, in the system of FIG. 2 an indication of the degree of sealing of an ear canal is generated based on the frequency spectrum, and thus based on the frequency characteristics of the microphone signal. Indeed, it has been found that a very reliable seal quality indication can be generated by considering frequency characteristics of the captured microphone signals. Accordingly a low complexity, yet reliable indication of the seal quality can be derived. This can be achieved without considering any other parameters or measurements and may accordingly reduce cost.

The approach can be used to provide an improved application that involves measurements of body sounds in the ear canal. For example, the seal quality indication may be used as a reliability indication for the measured body sounds and may be used by the application to weight the measurement results. For example, for a binary seal quality, the application may ignore all measurement results that are made when the seal quality indication is indicative of the sealing being inefficient.

In many embodiments, the system may be arranged to generate a user alert in response to the seal quality indication. For example, an audio tone may be emitted with a frequency that depends on the quality indicated by the seal quality indication. This may assist the user in positioning the earpiece in the ear. As a specific example, when inserting the earpiece the user may start an initialization process wherein the seal quality indication is measured and used to generate a tone. The frequency of the tone is high when there is no seal and reduces for increasing seal quality. Thus, the user simply positions the earpieces until the frequency of the tone is minimized. The tone may then be switched off.

Other examples include spoken word feedback, earcons and auditory icons. An auditory icon could in this case be the sound of a cork in a bottle, for example. These sounds can be played back via the same earpiece if a loudspeaker is added.

Alternatively or additionally, a user alert may be generated in response to a determination that a detection of the seal quality does not meet a criterion. For example, when the seal quality indication indicates that the seal quality is not sufficient, a red light may be lit. The user can then readjust the earplug until the light switches off. In some embodiments, separate seal quality indications may be generated for the user's two ears and a user alert may be generated separately for the two ears. For example, two red lights may be used to indicate whether the seal of each ear is sufficient.

Hence, using the described approach, it is possible to analyze the seal and conclude whether the seal is good enough for extracting useful data based on measurements of body sounds in the ear canal. If not, the user may be notified such that he can insert the earpiece in a better way.

In many embodiments, the frequency spectrum may be generated in time segments/windows. For example, the first signal may be divided into blocks of 256 samples and the FFT may be applied thereto. The resulting frequency spectrums may then be averaged over a plurality of blocks to provide the frequency spectrum which is evaluated by the seal quality estimator 209. The averaging thus corresponds to determining a frequency spectrum over a longer duration than the individual FFT block, thereby allowing a more representative and smoother average frequency spectrum to be determined, while allowing low complexity and resource usage as a smaller FFT can be applied. Alternatively or additionally some smoothing or averaging can be performed in the frequency domain. For example, for the same sample rate, a 4096 sample FFT may be performed. A frequency spectrum divided into 256 bins may then be generated by each bin being the average of 16 FFT bins. This may be equivalent to performing a 256 point FFT in 16 consecutive time intervals and averaging the resulting spectra.

It will be appreciated that different frequency spectrum characteristics may be used in different embodiments.

Specifically the evaluation may be based on considering low frequency signal components present in the ear canal, either coming via bone conduction or from sounds present in the middle ear cavity. For the sounds inside the ear canal, the open end of the ear canal results in a high pass characteristic. As soon as the ear canal is sealed, the high pass characteristic is reduced and the sound pressure level of low-frequency sounds in the ear canal increases. This effect can be measured up to 2 kHz for certain occlusions. For body sounds, the increase in sound pressure level is largest for frequencies below around 100 Hz, which is the frequency range where the most important parts of the heart and motion sounds are located. Breathing sounds can largely be found between 100 Hz and 500 Hz, but are generally significantly less strong than the frequency components below 100 Hz. Depending of the depth of the insertion of the occluding object, the increase in sound pressure level for low frequencies varies. It is shown that for shallow insertions, where the occluding object is placed in the part of the ear canal that is surrounded by soft tissue, the increase is largest. Deep insertions, where the occluding object is placed in the bony part of the ear canal, lead to a lower increase in level for the low frequencies. The material used to create the occlusion, such as memory foam or rubber, also influences the resulting frequency characteristic of the sealed ear canal. Besides creating the increase in low frequencies inside the ear canal, the seal effectively attenuates the level of external sounds in the ear canal and thus in the signal of the ear canal microphone.

The system of FIG. 2 may thus in particular evaluate the frequency spectrum to determine the presence of any low frequency boost.

Figure 1:
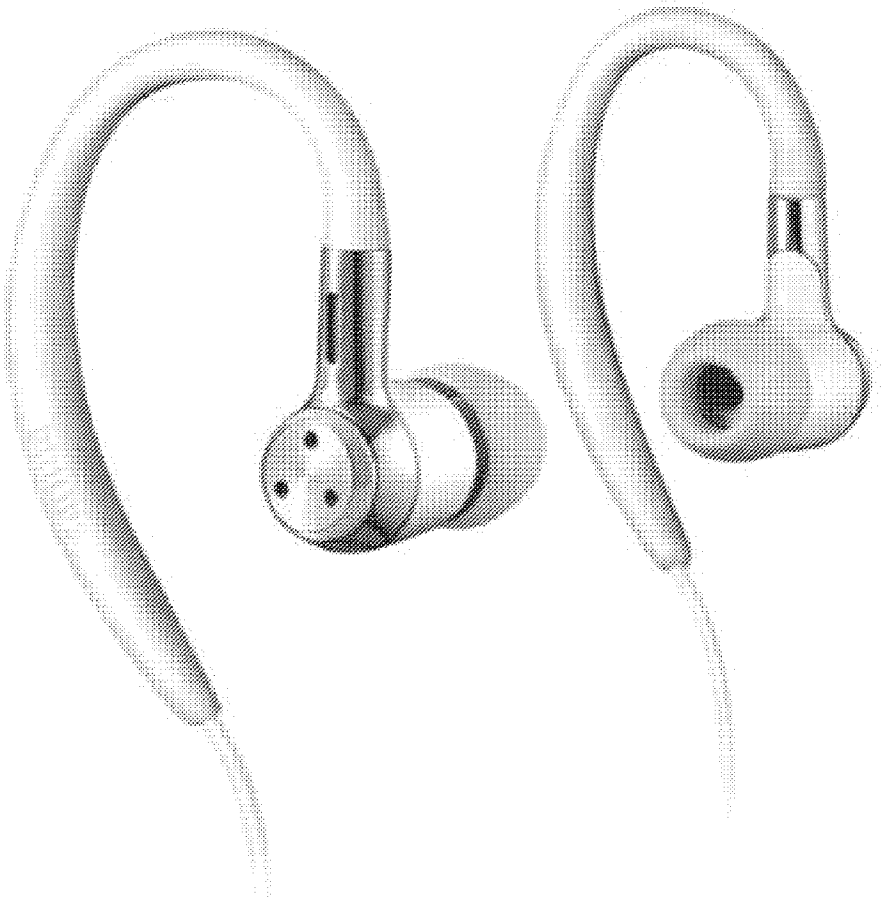
FIG. 1 is an illustration of a pair of earpieces for an ear canal microphone.
Figure 4:
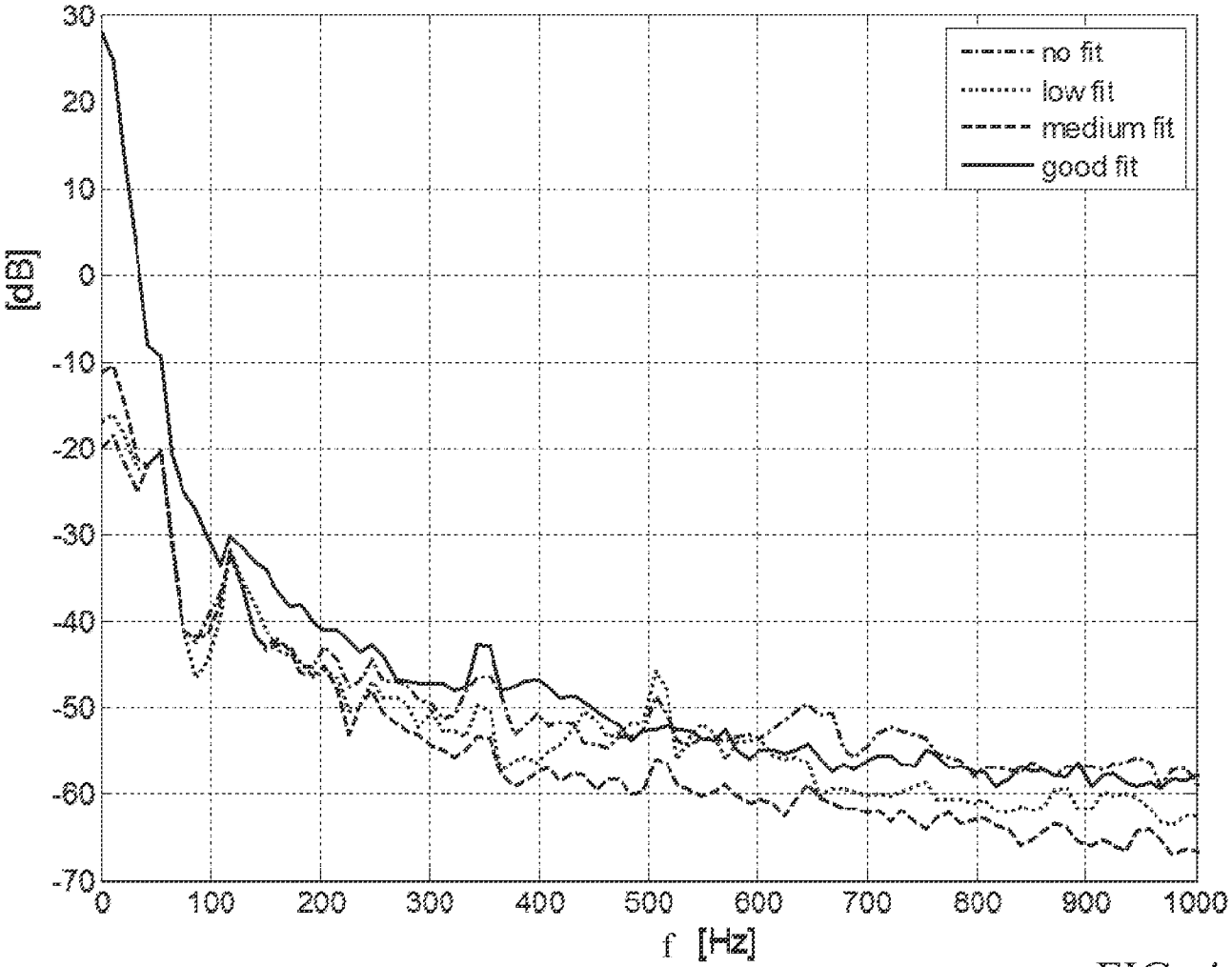
FIG. 4 is an illustration of magnitude spectra for signals captured by an ear canal microphone.

The effect may be illustrated by FIG. 4 which shows measurements of a frequency spectrum of an ear canal microphone (a Knowles Acoustics MB4015ASC-1 electret microphone with a diameter of 4 mm) mounted in a modified Philips SHS8001 earpiece (corresponding to the example of FIG. 1). The measurement was made for a user sitting on a chair and with no movements apart from breathing taking place. The measurements confirm that a very significant boost of frequencies below 100 Hz, and in particular frequencies below 50 Hz, is achieved when the fit is good, i.e. when a tight seal is achieved. The insertion depth of the earpiece can be considered to be shallow and results in a large increase in the level of the low frequencies, as expected from the article by Stenfelt and Reinfeldt, although the earpiece material was different. Due to the equipment used, measurements could go as low as 3 Hz and showed an occlusion effect of approximately 48 dB for the frequencies below 20 Hz for the specific earpiece.

As a low complexity example, the seal quality estimator 209 may simply measure a signal level in a low frequency band and then determine the seal quality as a function thereof. Indeed, in some embodiments, no other signal parameters may be considered.

For example, in some embodiments, the system may simply determine a peak amplitude, an average amplitude, or an accumulated amplitude (or corresponding measures of power or energy) in a low frequency band and generate the seal quality indication as a monotonic function thereof. As another example, the amplitude may simply be compared to a threshold and the seal may be designated to be acceptable if the threshold is exceeded, and designated to be unacceptable otherwise.

The low frequency band may advantageously be a band that does not exceed 200 Hz, 100 Hz, 70 Hz or 50 Hz depending on the requirements and preferences of the individual embodiment. Thus, the upper cut-off frequency may in many embodiments advantageously not exceed 200 Hz, 100 Hz, 70 Hz or 50 Hz. For a gradual roll-off, the cut-off frequency may be defined as a 3 dB, 6 dB or 10 dB roll-off frequency. In most scenarios, particular advantageous performance is achieved for the upper frequency being below 100 Hz.

In some embodiments the seal quality estimator 209 may specifically be arranged to determine a binary seal quality which is designated to be acceptable when a signal level in a frequency band having an upper cut-off frequency of no more than a 100 Hz exceeds a threshold, and designated to not be acceptable otherwise.

In many scenarios, other parameters or characteristics may of course affect the signal level at such low frequencies. For example, external noise may result in high signal levels; the microphone may exhibit self noise that is larger at lower frequencies resulting in the microphone signal having a low frequency boost even when not in a sealed configuration (and in a quiet environment); etc. However, in many applications or scenarios such characteristics can be compensated for or taken into consideration, or are not sufficient to be significant. For example, for a quiet environment, a known frequency characteristic of the microphone signal (i.e. a known frequency spectrum of the self noise), and known preamplifier settings, the effects can be predicted and compensated. E.g. a simple signal level determination or threshold detection is often sufficient to provide a sufficiently accurate seal quality indication. The threshold e.g. be selected taking the predicted characteristics into account.

In some embodiments, the seal quality estimator 209 is arranged to determine a detection characteristic which is indicative of a variation of a magnitude of the frequency spectrum with frequency. The seal quality is then determined based on the detection characteristic. Thus, in many embodiments, the seal quality estimator 209 proceeds to determine the seal quality indication based on a consideration of the variation of the magnitude of the frequency spectrum with frequency.

Indeed, in some embodiments, the detection characteristic may correspond to a gradient of the magnitude as a function of frequency in a frequency interval. Thus, the gradient or slope is considered when determining the seal quality indication. The frequency interval is typically advantageously a low frequency band with an upper frequency below 150 Hz or indeed in some scenarios advantageously below 100 Hz, 70 Hz or even 50 Hz.

Hence, the seal quality estimator 209 may proceed to determine the slope or gradient of the magnitude in the low frequency band. As can be seen from FIG. 4, a very high magnitude of the gradient is present when the seal is good whereas the magnitude of the slope is much reduced for less efficient seals. The seal quality indication may therefore be determined to be indicative of an increasing seal quality for increasing magnitudes of the gradient.

As a low complexity example, the seal quality estimator 209 may simply compare the gradient to a threshold and determine that the seal quality is acceptable if the magnitude of the gradient is above a threshold, and not acceptable if it is below the threshold.

An advantage of a gradient based approach is that it is less susceptible to absolute signal levels and that it more directly evaluates the shape of the frequency spectrum.

Alternatively or additionally, the seal quality indication may be determined in response to a comparison of a combined signal level in a first frequency band having an upper frequency, and a combined signal level in a frequency interval including a second frequency band above the upper frequency.

The seal quality indication can in many scenarios advantageously be based on a relative determination which compares energy in a first frequency band to energy in another frequency band that includes higher frequencies.

Again, the low frequency band may advantageously have an upper frequency of no more than 150 Hz or indeed in some scenarios advantageously of no more than 100 Hz, 70 Hz or even 50 Hz.

The frequency interval may be considered as a reference band that the low frequency signal level is compared to. Indeed, the use of such a reference frequency band can compensate for a number of variable parameters, such as preamplifier gain settings, and to some extent external noise signals (as these are likely to not have a low frequency boost comparable to that of the occlusion effect).

The reference frequency band may in many embodiments advantageously have an upper frequency of no less than 500 Hz. Indeed, in many scenarios it is advantageous that such higher frequencies are included in the reference frequency band as they provide an improved reference.

In some embodiments, the lower frequency of the reference frequency band may extend into the first frequency band, i.e. it may include low frequencies. As an example, the reference frequency band may cover the entire audio band, i.e. the energy of the reference frequency band may simply correspond to the energy of the frequency spectrum as a whole.

In other embodiments, the reference frequency band may not overlap the first frequency band. Indeed, in some embodiments the reference frequency band may be a narrow reference band at much higher frequencies than the first frequency band. It may specifically have the same bandwidth as the first frequency band.

The reference frequency band may in some embodiments advantageously have a lower frequency of no less than 500 Hz, or in some cases 700 Hz or 1 kHz. Indeed, in many scenarios it is advantageous that only higher frequencies are included in the reference frequency band as they provide an improved reference in many scenarios.

Indeed, heart sounds are typically found below 100 Hz and breathing sounds are typically found in the range between 100 Hz and 500 Hz. The described seal detection algorithm focuses on the frequency range of the heart sounds, and for the high reference band it may often be advantageous to consider frequencies that do not contain significant body sounds. Therefore, it can be advantageous not to include frequencies in the breathing frequency band.

It will be appreciated that many different design choices for the filters and for the frequency consideration in general may be used.

For example, the system may determine the seal quality by comparing the level of the noise floor, say above 800 Hz, with the level in the frequencies below 50 Hz. Depending on the type of seal, a big difference can be expected in the ratio between those levels when the seal is correct compared to when the seal is flawed. This works both in the motionless and the movement scenarios (including e.g. walking, running, cycling etc).

Examples of such an approach include e.g.

Finding the frequency bin with the highest value in the first 50 Hz and dividing that value by the value of frequency bin of the spectrum close to 800 Hz. Integrating the region from 0-50 Hz (e.g. by summation of the frequency bins) and dividing the resulting value by the value obtained by integrating the region from 800-850 Hz.

A simple binary seal quality indication may be determined in response to such energy ratios. E.g. if the ratio is high enough, the seal is correct and if the ratio is not sufficiently high it may be considered insufficient.

As in the previous examples, a frequency transform may be applied to the first signal to generate a frequency spectrum for the first signal. The seal quality indication may then be determined in response to the frequency spectrum. Thus, a frequency characteristic may be determined from the frequency spectrum and the seal quality indication may be determined based on this frequency characteristic.

However, it is respectfully submitted that a full explicit frequency spectrum need not be generated in order to determine the frequency characteristic. For example, in some embodiments only signal levels in the relevant frequency bands used for determining the seal quality indication may be derived. This may e.g. be done by filtering the first signal.

For example, the seal quality indication may simply be determined to correspond to signal energy in a low frequency band. E.g. a low pass filter with a cut-off frequency in the range from 50-100 Hz may be applied to the first signal and the filter output signal may be used to directly as the seal quality indication or may e.g. be compared to a threshold to determine a binary seal quality indication. As another example, a high pass filter with a lower cut-off frequency of, say, 500 Hz may be applied to the first signal to generate a reference signal level. The seal quality indication may then be given as the ratio between the output signals from the filters.

In some embodiments, the system may further be arranged to determine a user motion characteristic in response to the microphone signal. As a low complexity example, the system may simply estimate whether the user is moving or not. The user motion characteristic may then be taken into account when determining the seal quality indication.

For example, the seal quality indication may only be determined when the user motion characteristic meets a criterion and/or different processing to determine the seal quality may be used dependent on the user motion characteristic.

Typically, the bone conducted sound in the ear canal has substantially higher level for footsteps than for sounds originating from heartbeats or breathing. Indeed, typically the level of footstep sounds are at least 10-20 dB higher than heartbeat sounds, and often 40-50 dB higher than breathing sounds. The system may therefore adapt the operation depending on whether the user motion characteristic is indicative of the user moving or being static.

The motion detection may simply be based on a detection of the level of low frequency sounds. Thus, the system may simply monitor the signal level in a low frequency band and if the level exceeds a given threshold, the user may be considered to be moving and otherwise the user may be considered to be static. Such a measurement may be relatively reliable due to the significant level difference between the signal levels resulting from footsteps and from heartbeats or breathing.

In more complex embodiments, the user motion characteristic may alternatively or additionally be determined in response to other parameters. For example, the system may detect individual patterns in the time-domain signal or the frequency spectrum and compare them to patterns expected for breathing, heartbeats and footsteps.

The system may be arranged to set a processing parameter for the microphone signal in response to the motion characteristic. The processing parameter may for example be a gain setting, a filter characteristic etc. Specifically, the system may be arranged to perform a gain adjustment in response to the user motion characteristic. Thus, when the user motion characteristic is indicative of the user moving, the gain may be reduced substantially to reflect the substantially increased signal level.

In some embodiments, the system may comprise an automatic gain control that sets the gain to result in a substantially constant signal level in a low frequency band (e.g. having an upper frequency of no more than 150 Hz, 100 Hz, 70 Hz or 50 Hz). The gain setting may then be used to derive the user motion characteristic.

The system may thus be arranged to differentiate between the user being in motion (walking or running) and the user being still. As an example, an output signal from a signal level detector may be compared to a threshold in order to distinguish between the motionless and motion situations. This may help to differentiate between these conditions when determining the seal quality indication. For example, frames or blocks containing motion may be processed separately from frames or blocks without apparent movement. Subsequently, spectra for both cases may be determined and seal quality indications may be derived for both cases. A single seal quality indication may then be generated by an averaging or weighting of the individual seal quality indications.

In some embodiments, the system may be arranged to compensate for the acoustic environment the system is used in. The system may comprise a microphone arranged to capture the external audio environment. For example, a microphone may be arranged on the outside of the earpiece, and/or an external microphone may e.g. be attached elsewhere on the user or placed away from the user.

The ambient microphone signal captured by the microphone external to the ear canal may then be used to determine the seal quality indication. In this way the system may compensate for variations in the external acoustic environment. The compensation may be a dynamic compensation thus allowing the system to adapt to the current acoustic environment.

As an example, both the microphone signal from the ear canal microphone 201 and from the external microphone may be coupled to the pre-processing circuit 205 which may proceed to generate the first signal as a difference signal between these. Thus, the pre-processing circuit 205 subtracts a component corresponding to the external noise from the signal capture in the ear canal. This may be particularly efficient in allowing the approach to be used in noisy and varying acoustic environments. Typically the ambient microphone signal may be filtered prior to being subtracted from the ear canal microphone signal. The filtering may specifically emulate the filtering provided by the sealing of the ear by the earpiece.

As previously mentioned, the microphone signal may be used by a body sound application which evaluates body sounds captured in the ear canal. Such applications may for example include relaxation, medical or exercise applications.

In some embodiments, the system may be arranged to adapt a characteristic of the processing of the body sound application in response to the seal quality indication. For example, the seal quality indication may be considered as a reliability indication for whether the microphone signal can be considered to comprise body sounds or not. Thus, the application may simply ignore the microphone signal when the seal quality indication is indicative of a seal quality which is too low. As another example an averaging of results based on body sounds may be weighted by the seal quality indication.

In examples where separate seal quality indications are generated for both ears, the corresponding seal quality indications may e.g. be used to select between body sound measurements for the two ears, or e.g. to weight the measurements according to the indicated reliability.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A method of detecting a seal quality indication for a seal of an ear canal, the method comprising:

receiving a microphone signal from an ear canal microphone positioned in the ear canal;

generating a first signal from the microphone signal; and determining the seal quality indication in response to a characteristic of a frequency spectrum of the first signal; wherein the seal quality indication is determined in response to a comparison of a combined signal level in a first frequency band having an upper frequency, and a combined signal level in a frequency interval including a second frequency band of frequencies above the upper frequency.

2. The method of claim 1 the seal quality indication is determined in response to a variation of a magnitude of the frequency spectrum with frequency.

3. The method of claim 2 where the seal quality indication is determined in response to a gradient of the magnitude as a function of frequency in a frequency interval.

4. The method of claim 3 wherein determining the seal quality indication comprises determining the seal quality indication to indicate an increasing value of quality for an increasing amplitude of the gradient.

5. The method of claim 1 wherein the upper frequency is not above 100 Hz.

6. The method of claim 1 wherein the second frequency band has an upper frequency of no less than 500 Hz.

7. The method of claim 1 wherein the seal quality indication is determined as a function of no other signal dependent parameters than a signal level in a frequency band having an upper cut-off frequency of no more than a 100 Hz.

8. The method of claim 1 further comprising generating a user alert in response to a detection of the seal quality indication not meeting a criterion.

9. The method of claim 8, wherein said method further comprises setting a processing parameter for the microphone signal in response to the user motion characteristic.

10. The method of claim 9, wherein said method further comprises setting a processing parameter for the microphone signal in response to the user motion characteristic.

11. The method of claim 1 further comprising receiving an ambient microphone signal from a microphone external to the ear canal; and wherein the seal quality indication is further determined in response to the ambient microphone signal.

12. The method of claim 1 further comprising generating the frequency spectrum by an averaging of frequency spectrums of a plurality of windows.

13. The method of claim 1 further comprising:

executing a body sound application based on the microphone signal; and adapting a characteristic of a processing of the body sound application in response to the seal quality indication.

14. An apparatus for determining a seal quality indication for a seal of an ear canal, the apparatus comprising:

an input for receiving a microphone signal from an ear canal microphone;

a circuit for generating a first signal from the microphone signal; and a circuit for determining the seal quality indication in response to a characteristic of a frequency spectrum of the first signal; wherein the circuit for determining the seal quality indication is arranged to determine the seal quality indication in response to a comparison of a combined signal level in a first frequency band having an upper frequency, and a combined signal level in a frequency interval including a second frequency band of frequencies above the upper frequency.

* * * * *